US008914982B1

(12) United States Patent
Skluzak

(10) Patent No.: US 8,914,982 B1
(45) Date of Patent: Dec. 23, 2014

(54) QUICK RELEASE UTILITY KNIFE BLADE HOLDER

(71) Applicant: Dell Skluzak, Lakewood, CO (US)

(72) Inventor: Dell Skluzak, Lakewood, CO (US)

( * ) Notice: Subject to any disclaimer, the term of this patent is extended or adjusted under 35 U.S.C. 154(b) by 206 days.

(21) Appl. No.: 13/746,728

(22) Filed: Jan. 22, 2013

(51) Int. Cl.
*B26B 5/00* (2006.01)

(52) U.S. Cl.
CPC ..... *B26B 5/00* (2013.01)
USPC ..... 30/339; 30/337

(58) Field of Classification Search
CPC ..... B26B 5/001; B26B 5/006
USPC ..... 30/329, 332, 33, 337, 338, 339
See application file for complete search history.

(56) References Cited

U.S. PATENT DOCUMENTS

| | | | | | |
|---|---|---|---|---|---|
| 936,592 | A | * | 10/1909 | Wilson | 30/320 |
| 1,448,730 | A | * | 3/1923 | Davis | 30/337 |
| 1,596,277 | A | * | 8/1926 | Langbein | 30/337 |
| 1,611,732 | A | * | 12/1926 | Fekete | 30/337 |
| 1,636,062 | A | * | 7/1927 | Maclure | 30/333 |
| 1,774,680 | A | * | 9/1930 | Thomas | 30/336 |
| 1,877,827 | A | * | 9/1932 | Drache | 279/44 |
| 2,459,407 | A | * | 1/1949 | Beaver | 30/337 |
| 2,601,388 | A | * | 6/1952 | Guarino | 30/32 |
| 3,255,523 | A | * | 6/1966 | Robertson et al. | 30/32 |
| 3,845,554 | A | * | 11/1974 | Joanis et al. | 30/125 |
| 4,173,071 | A | * | 11/1979 | Ishida | 30/339 |
| 4,612,707 | A | * | 9/1986 | Shea | 30/162 |
| 4,646,440 | A | * | 3/1987 | Decker | 30/339 |
| 6,216,868 | B1 | * | 4/2001 | Rastegar et al. | 206/359 |
| 7,194,809 | B2 | | 3/2007 | Skluzak | |
| 7,520,059 | B2 | * | 4/2009 | Ranieri et al. | 30/162 |
| 8,201,336 | B2 | | 6/2012 | De | |
| 2002/0096032 | A1 | | 7/2002 | Peyrot et al. | |
| 2003/0037444 | A1 | * | 2/2003 | Chunn | 30/337 |
| 2005/0204567 | A1 | * | 9/2005 | Ping | 30/161 |
| 2009/0165309 | A1 | | 7/2009 | Kamb et al. | |
| 2009/0300920 | A1 | * | 12/2009 | Jiang | 30/152 |
| 2012/0180326 | A1 | * | 7/2012 | Wu et al. | 30/337 |

* cited by examiner

*Primary Examiner* — Hwei C Payer
(74) *Attorney, Agent, or Firm* — Donald J. Ersler

(57) ABSTRACT

A quick release utility blade holder preferably includes a handle member and a retention clip. The handle member preferably includes a clip pocket, which is sized to receive the retention clip. A pair of opposed blade grooves are formed below a bottom of the clip pocket to slidably receive a utility knife blade. The retention clip includes a lift tab, a notch lock projection and a blade stop projection. The blade stop projection stops insertion of the utility knife blade. The notch lock projection is sized to be received by one of the notches in the utility knife blade. The lift tab extends from one end of the retention clip at one end of the handle member and one end of the clip pocket. The other end of the retention clip is secured to the handle member at the other end of the clip pocket with at least one fastener.

16 Claims, 3 Drawing Sheets

QUICK RELEASE UTILITY KNIFE BLADE HOLDER

BACKGROUND OF THE INVENTION

1. Field of the Invention

The present invention relates generally to knives and more specifically to a quick release utility knife blade holder, which allows a utility knife blade to be removed and installed quickly.

2. Discussion of the Prior Art

Patent application no. 2002/0096032 to Peyrot et al. discloses a cutter monoblock blade carrier with securement and release of the blade by pressure. U.S. Pat. No. 7,194,809 to Skluzak discloses a quick release blade and knife. Patent application no. 2009/0165309 to Kamb et al. discloses a utility knife with blade release mechanism. U.S. Pat. No. 8,201,336 to De discloses a retractable utility knife.

Accordingly, there is a clearly felt need in the art for a quick release utility knife blade holder, which allows a utility knife blade to be removed and installed quickly; and which is more economical to manufacture than that of the prior art.

SUMMARY OF THE INVENTION

The present invention provides a quick release utility knife blade holder, which is more economical to manufacture than that of the prior art. The quick release utility knife blade holder (quick release blade holder) preferably includes a handle member and a retention clip. The handle member includes an elongated shape. A clip pocket is preferably formed in one end of the handle member. The clip pocket is sized to receive the retention clip. A pair of opposed blade grooves are formed below a bottom of the clip pocket, substantially parallel to a bottom of the clip pocket. The pair of opposed blade grooves are sized to slidably receive a thickness of a utility knife blade. The retention clip preferably includes a lift tab, a notch stop projection and a blade stop projection. The lift tab extends from one end of the retention clip at the one end of the handle member and one end of the clip pocket. The other end of the retention clip is secured to the handle member at the other end of the clip pocket with at least one fastener.

In use, the retention clip is pulled away from the one end of the clip pocket with the lift tab; and the utility knife blade is inserted into the pair of opposed blade grooves, until an end of the utility knife blade contacts the blade stop projection. The lift tab is released and the notch lock projection is located to fit in one of the notches on a top of the utility knife blade. The notch lock projection prevents axial movement of the utility knife blade within the pair of opposed blade grooves. The utility knife blade is removed by pulling the retention clip away from the clip pocket with the lift tab, until the notch lock projection is pulled out of the notch in the utility knife blade and pulling the utility knife blade out of the pair of opposed blade grooves.

Accordingly, it is an object of the present invention to provide a quick release blade holder, which allows a utility knife blade to be removed and installed quickly.

Finally, it is another object of the present invention to provide a quick release blade holder, which is more economical to manufacture than that of the prior art.

These and additional objects, advantages, features and benefits of the present invention will become apparent from the following specification.

DETAILED DESCRIPTION OF THE PREFERRED EMBODIMENTS

Figure 1:
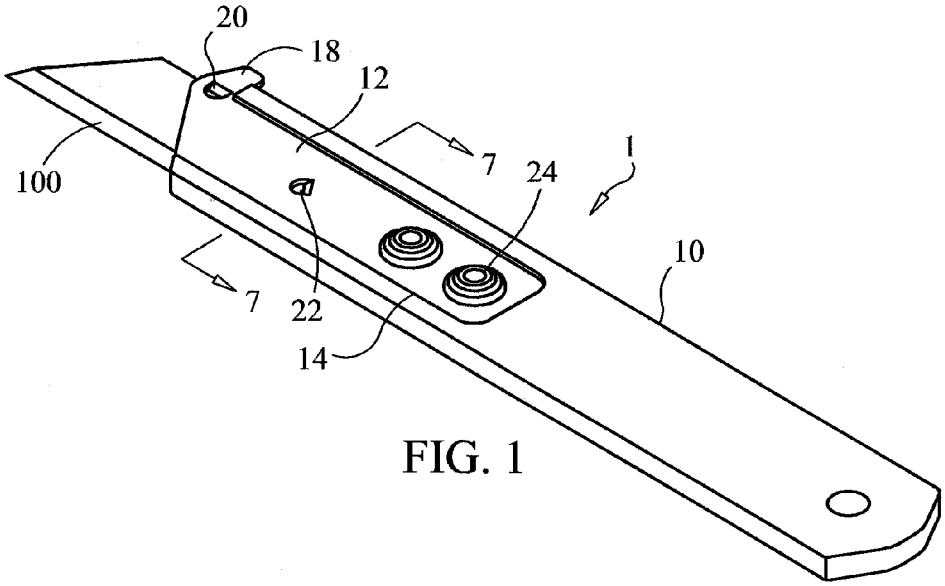
FIG. 1 is a perspective view of a quick release blade holder retaining a utility knife blade in accordance with the present invention.
Figure 2:
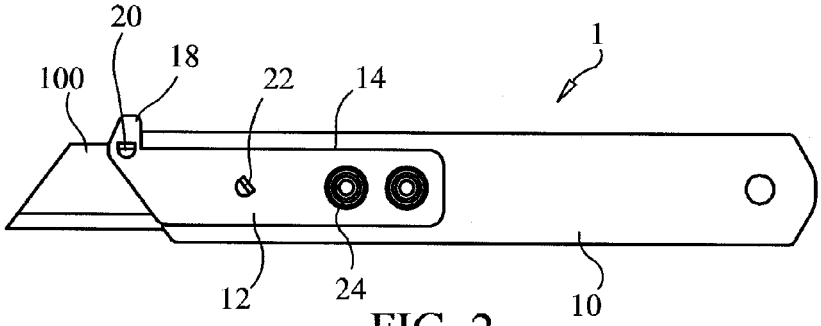
FIG. 2 is a front view of a quick release blade holder retaining a utility knife blade in accordance with the present invention.
Figure 3:
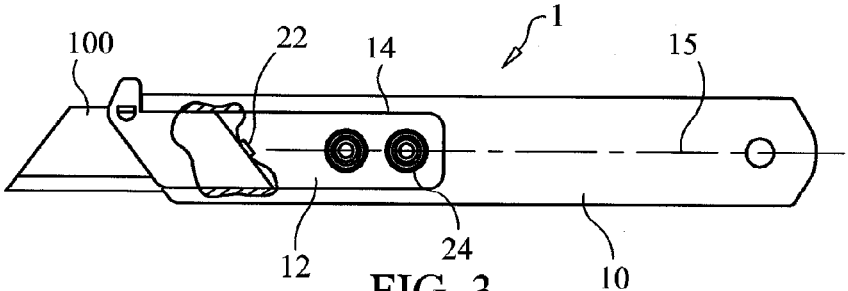
FIG. 3 is a front view of a quick release blade holder retaining a utility knife blade with a portion of a retention clip cut-away to illustrate a blade stop projection in accordance with the present invention.
Figure 4:
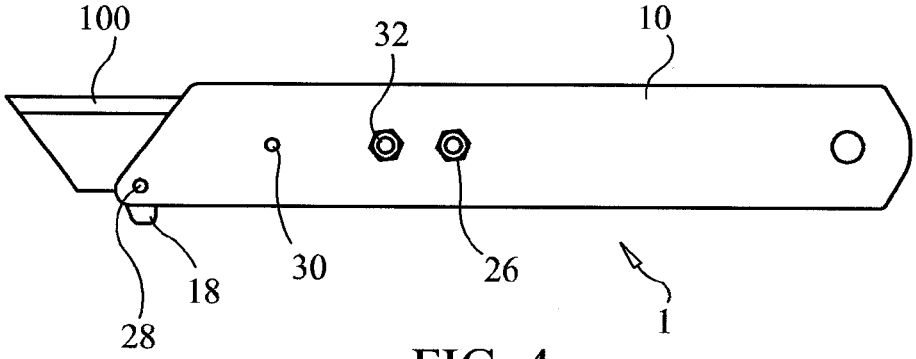
FIG. 4 is a rear view of a quick release blade holder retaining a utility knife blade in accordance with the present invention.
Figure 5:
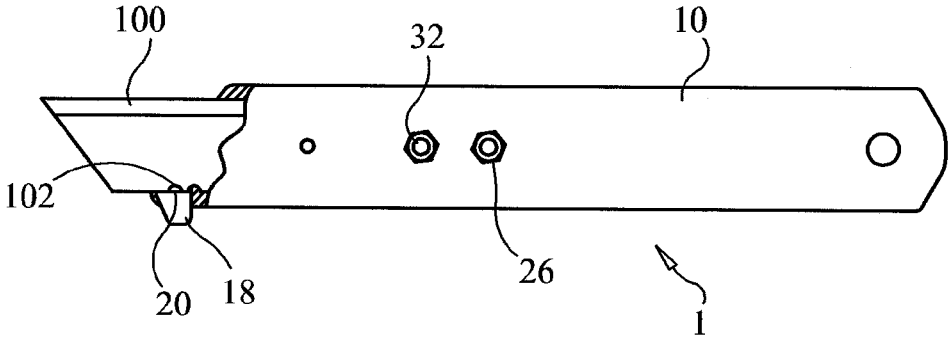
FIG. 5 is a rear view of a quick release blade holder retaining a utility knife blade with a portion of a handle member cut-away to illustrate a notch lock projection in accordance with the present invention.
Figure 6:
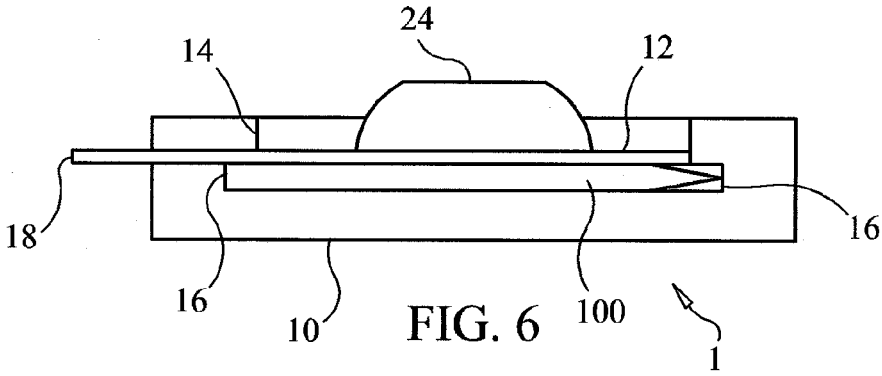
FIG. 6 is an enlarged end view of a quick release blade holder retaining a utility knife blade in accordance with the present invention.
Figure 7:
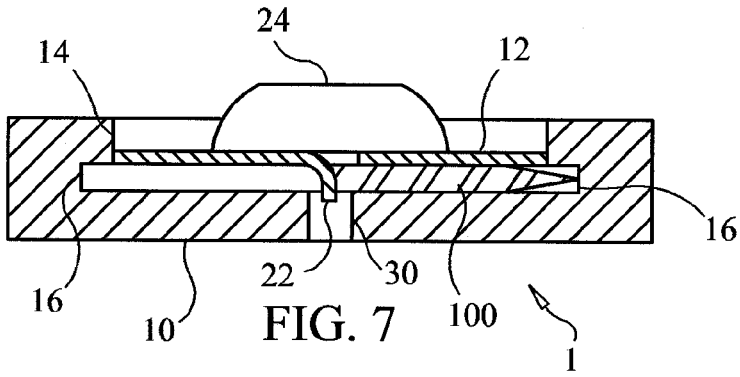
FIG. 7 is an enlarged cross sectional view of a quick release blade holder illustrating a blade stop projection in accordance with the present invention.
Figure 8:
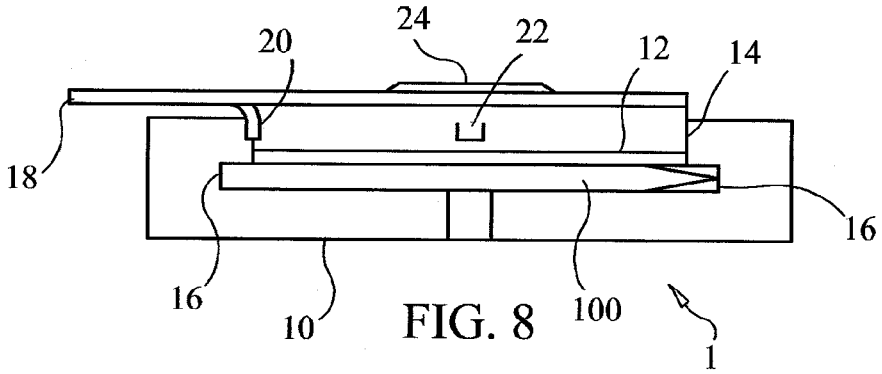
FIG. 8 is an enlarged cross sectional view of a quick release blade holder with a retention clip pulled away from a clip pocket to remove or insert a utility knife blade in accordance with the present invention.

With reference to the drawings, and particularly to FIG. 1, there is shown a perspective view of a quick release blade holder 1. With reference to FIGS. 2-5, the quick release blade holder 1 preferably includes a handle member 10 and a retention clip 12. The handle member 10 includes an elongated shape. A clip pocket 14 is formed in one end of the handle member 10. The clip pocket 14 is sized to receive the retention clip 12. With reference to FIG. 6, a pair of opposed blade grooves 16 are formed below a bottom of the clip pocket 14, substantially parallel to a bottom of the clip pocket 14. A length of the pair of opposed blade grooves 16 are substantially parallel to an axis 15 of the handle member 10. The pair of opposed blade grooves 16 are sized to slidably receive a thickness of a utility knife blade 100. With reference to FIGS. 7-8, the retention clip 12 preferably includes a lift tab 18, a notch lock projection 20 and a blade stop projection 22. The lift tab 18 extends from one end of the retention clip 12 at the one end of the handle member 10 and one end of the clip pocket 14. The other end of the retention clip 12 is preferably secured to the handle member 10 at the other end of the clip pocket 14 with at least one fastener 24 and a nut 26. However, the retention clip 12 may be secured to the handle member 10 with any other suitable fastening technique. The retention clip 12 is fabricated from a material having memory, such as spring steel.

The notch lock projection 20 is preferably formed through the retention clip 12, adjacent the lift tab 18 with a lancing operation. However, the notch lock projection 20 may also be created with any other suitable structure, method or technique. The notch lock projection 20 is sized to be received by one of the two notches 102 formed in a top of the utility knife blade 100. A notch lock receiver hole 28 is formed through the handle portion 10 to receive the notch lock projection 20. The blade stop projection 22 is preferably formed through substantially a middle of the retention clip 12 with a lancing operation. However, other types of blade stops may also be used, such as a dowel extending from the handle member 10. A blade stop clearance hole 30 is formed through the handle portion 10 to provide clearance for the blade stop projection 22. A hexagon opening 32 is preferably formed through the handle to receive the nut 26.

In use, the retention clip 12 is pulled away from the clip pocket 14 with the lift tab 18; and the utility knife blade 100 is inserted into the pair of opposed blade grooves 16, until an end of the utility knife blade 100 contacts the blade stop projection 22. The lift tab 18 is released and the notch lock projection 20 is located to fit in one of the two notches 102. The notch stop projection 20 prevents axially movement within the pair of opposed blade grooves 16. The utility knife blade 100 is removed by pulling the retention clip 12 away from the clip pocket 14 with the lift tab 18, until the notch lock projection 20 is pulled out of the notch 102 and pulling the utility knife blade 100 out of the pair of opposed blade grooves 16.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A quick release utility knife blade holder comprising:

a retention clip includes a notch lock projection;

a handle member, one end of said retention clip is secured to said handle member, a pair of opposed blade grooves are formed in one end of said handle member, said pair of opposed blade grooves are sized to slidably receive a utility knife blade, said notch lock projection is sized to be received by a notch of the utility knife blade; and a blade stop for stopping the axial insertion of the utility knife blade wherein said blade stop is formed as an integral portion of said retention clip.

2. The quick release utility knife blade holder of claim 1, further comprising:

a lift tab extends from the other end of said retention clip adjacent said notch lock projection.

3. The quick release utility knife blade holder of claim 1 wherein:

said retention clip is fabricated from a material having memory.

4. The quick release utility knife blade holder of claim 1 wherein:

said one end of said retention clip is secured to said handle member with at least one fastener.

5. The quick release utility knife blade holder of claim 1 wherein:

a notch lock receiver hole is formed in said handle member concentric with said notch lock projection.

6. A quick release utility knife blade holder comprising:

a retention clip includes a notch lock projection; and a handle member includes a clip pocket formed in one end thereof, one end of said retention clip is secured in said clip pocket, a pair of opposed blade grooves are formed in said one end of said handle member, said pair of opposed blade grooves are sized to slidably receive a utility knife blade, said notch lock projection is sized to be received by a notch of the utility knife blade.

7. The quick release utility knife blade holder of claim 6, further comprising:

a blade stop for stopping the axial insertion of the utility knife blade.

8. The quick release utility knife blade holder of claim 7, further comprising:

said blade stop is formed as an integral portion of said retention clip.

9. The quick release utility knife blade holder of claim 6, further comprising:

a lift tab extends from the other end of said retention clip adjacent said notch lock projection.

10. The quick release utility knife blade holder of claim 6 wherein:

said retention clip is fabricated from a material having memory.

11. The quick release utility knife blade holder of claim 6 wherein:

said one end of said retention clip is secured to said handle member with at least one fastener.

12. The quick release utility knife blade holder of claim 6 wherein:

a notch lock receiver hole is formed in said handle member concentric with said notch lock projection.

13. A quick release utility knife blade holder comprising:

a retention clip includes a notch lock projection, said notch lock projection extends from one end of said retention clip;

a handle member includes a clip pocket formed in one end thereof, the other end of said retention clip is secured to said handle member, a pair of opposed blade grooves are formed in said one end of said handle member, said pair of opposed blade grooves are substantially parallel to an axis of said handle member, said pair of opposed blade grooves are sized to slidably receive a utility knife blade, said notch lock projection is sized to be received by a notch of the utility knife blade; and a blade stop for stopping the axial insertion of the utility knife blade wherein said blade stop is formed as an integral portion of said retention clip.

14. The quick release utility knife blade holder of claim 13, further comprising:

a lift tab extends from said one end of said retention clip adjacent said notch lock projection.

15. The quick release utility knife blade holder of claim 13 wherein:

said retention clip is fabricated from a material having memory.

16. The quick release utility knife blade holder of claim 13 wherein:

the other end of said retention clip is secured to said handle member with at least one fastener.

* * * * *